US010815662B1

(12) United States Patent
Smith

(10) Patent No.: US 10,815,662 B1
(45) Date of Patent: Oct. 27, 2020

(54) CEILING PANEL MOUNTING CLIP

(71) Applicant: Monarch Metal, Inc., Ronkonkoma, NY (US)

(72) Inventor: Christopher L. Smith, St. Petersburg, FL (US)

(73) Assignee: Monarch Metal, Inc., Ronkonkoma, NY (US)

( * ) Notice: Subject to any disclaimer, the term of this patent is extended or adjusted under 35 U.S.C. 154(b) by 2 days.

(21) Appl. No.: 16/365,452

(22) Filed: Mar. 26, 2019

(51) Int. Cl.
*E04B 9/18* (2006.01)
*E04B 9/02* (2006.01)
*A47G 1/16* (2006.01)
*E04B 9/16* (2006.01)

(52) U.S. Cl.
CPC ..... *E04B 9/183* (2013.01); *E04B 9/02* (2013.01); *A47G 1/1606* (2013.01); *E04B 9/16* (2013.01)

(58) Field of Classification Search
CPC ... E04B 9/02; E04B 9/16; E04B 9/183; A47G 1/1606
USPC ..... 248/205.2, 220.21, 489, 497, 475.1
See application file for complete search history.

(56) References Cited

U.S. PATENT DOCUMENTS 1,772,687 A * 8/1930 Reinke ..... F16L 3/04 24/129 R
1,878,084 A * 9/1932 Winkler ..... F21V 21/02 362/439
1,908,200 A * 5/1933 Webster ..... A47G 1/1686 248/495
2,304,480 A * 12/1942 Schramm ..... E04B 9/32 248/343
2,687,867 A * 8/1954 Isidore ..... F21V 21/03 248/343
3,601,862 A * 8/1971 Hargadon ..... A47F 5/08 24/343
3,955,790 A * 5/1976 Ballin ..... A47G 1/1606 248/489
3,965,600 A * 6/1976 Paskerian ..... A47G 1/06 40/759
4,012,023 A * 3/1977 Melanson ..... A47G 1/1653 248/489

(Continued)

FOREIGN PATENT DOCUMENTS

DE 3401271 A1 7/1985
JP 406158814 A 6/1994

OTHER PUBLICATIONS

2018 Monarch Metal Fabrication, www.monarchmetal.com, Wall Panel & Cladding Installation Hardware Catalog.

*Primary Examiner* — Eret C McNichols
(74) *Attorney, Agent, or Firm* — Zollinger & Burleson Ltd

(57) ABSTRACT

A ceiling panel mounting clip is interlocked with a second clip to mount a ceiling panel with the interlocked clips hidden from viewed from below the ceiling panel. The interlocked clips hold the ceiling panel without fasteners holding the clips together. The interlocked clips restrain movement of the ceiling panel in the lateral and downward directions. The ceiling panel mounting clip includes a base having a front end, a rear end, and lateral edges. An arm projects away from the base with the arm having a lower end, an upper end, and lateral edges. The arm defines an opening through one of its lateral edges with the arm having a lower edge, an upper edge, and a central edge that define the boundaries of the opening. A lock tab projects from an upper portion of the arm away from the opening.

26 Claims, 7 Drawing Sheets

(56) References Cited

U.S. PATENT DOCUMENTS 4,069,998 A * 1/1978 Rytting ..... A47G 1/1606 248/225.21
4,228,982 A * 10/1980 Sellera ..... A47G 1/1606 248/467
4,458,873 A * 7/1984 Sutherland ..... A47G 1/162 206/499
4,610,418 A * 9/1986 Graham ..... A47G 1/1606 248/495
4,712,761 A * 12/1987 Wassell ..... A47G 1/1606 248/220.1
4,726,165 A * 2/1988 Brinsa ..... E04B 9/18 52/665
4,873,809 A * 10/1989 Paul ..... E04B 9/242 52/506.07
5,924,246 A * 7/1999 Jurgens ..... G09F 7/18 248/317
6,055,787 A 5/2000 Gerhaher et al.
6,170,214 B1 1/2001 Treister et al.
6,286,802 B1 * 9/2001 Munson ..... A47G 1/1606 248/475.1
D542,631 S * 5/2007 Munson ..... D8/373
7,322,157 B2 * 1/2008 Hang ..... E04B 9/003 248/322
7,665,260 B2 2/2010 Hikai
D617,011 S 6/2010 Guffey
7,849,651 B2 12/2010 Fujito et al.
7,891,124 B1 * 2/2011 Willis ..... A47G 1/1606 248/477
8,371,543 B2 * 2/2013 Schneider ..... A47G 1/1606 248/224.8
8,596,009 B2 * 12/2013 Baxter ..... E04B 7/14 52/506.06
9,109,368 B2 8/2015 MacKenzie
9,194,123 B2 * 11/2015 Holdridge ..... E04B 9/06
9,896,849 B1 2/2018 Aboukhalil
2003/0038222 A1 * 2/2003 Holmes ..... A47G 1/1606 248/475.1
2004/0148894 A1 * 8/2004 Kelley ..... E04B 9/241 52/506.01
2005/0072894 A1 * 4/2005 Grant ..... A47G 1/1606 248/475.1
2009/0050775 A1 * 2/2009 Constantinou ..... A47G 1/1606 248/489
2010/0302127 A1 * 12/2010 Frank ..... H01Q 1/007 343/892
2014/0231611 A1 * 8/2014 Svihilik ..... A47G 1/0638 248/476
2016/0053489 A1 * 2/2016 Porter ..... F16B 5/0225 52/506.08
2017/0318988 A1 * 11/2017 Voyles ..... A47G 1/14
2020/0085215 A1 * 3/2020 Ng ..... A47G 1/1606

* cited by examiner

CEILING PANEL MOUNTING CLIP

BACKGROUND OF THE DISCLOSURE

1. Technical Field

The disclosure generally relates to hardware for mounting one device to another and, more particularly, to ceiling panel mounting clips used to mount ceiling panels below a ceiling with clips that are hidden from view. Specifically, the disclosure relates to a ceiling panel mounting clip that can be used with a copy of itself to mount a ceiling panel below a ceiling while restraining movement of the ceiling panel in lateral and downward directions.

2. Background Information

A variety of architectural applications use ceiling panels suspended below a ceiling to provide a function or to provide an attractive appearance to a ceiling. Many applications seat the ceiling panels in a grid suspended below the ceiling with the panels carried by the grid. The lower members of the grid are visible and, although the engagements between the panels and the grids are not sealed, there is little airflow between the panel edges.

Other ceiling panel mounting configurations include brackets that extend down from the ceiling and hook over the edges or corners of the ceiling panels. These brackets also have the drawback of being visible. Still other ceiling panels are mounted with fasteners disposed though the panel and into the ceiling. The heads of these fasteners are visible or must be covered. Further ceiling panel support devices are hidden and are disposed between the panels and the ceiling from which they are supported.

SUMMARY OF THE DISCLOSURE

The disclosure provides a ceiling panel mounting clip that is interlocked with a second clip (typically as copy of itself) to mount a ceiling panel with the interlocked clips hidden from view. The interlocked clips hold the ceiling panel without fasteners holding the clips together. The interlocked clips substantially restrain movement of the ceiling panel in the lateral and downward directions. A single pair of clips can be used to mount a panel but typically a plurality of clip pairs are used to mount the panel from the ceiling.

In one configuration, the disclosure provides a ceiling panel mounting clip that includes a base having a front end, a rear end, and lateral edges; an arm projecting away from the base; the arm having a lower end, an upper end, and lateral edges; the arm defining an opening through one of its lateral edges; the arm having a lower edge, an upper edge, and a central edge that define the boundaries of the opening; a lock tab projecting from an upper portion of the arm away from the opening. Other configurations of the clip are disclosed with different geometries, different angles, and elements that project in different directions.

The disclosure also provides a mounting configuration for a ceiling panel with hidden mounting clips wherein a ceiling panel is suspended below a ceiling with a plurality of ceiling panel mounting clips. At least a pair of interlocked clips support the panel with one clip of the interlocked pair being fastened to the ceiling and the other of the interlocked pair being connected to the ceiling panel. The interlocked connection substantially restrains movement in the lateral and downward directions. The weight of the panel and the friction between the interlocked clips hold the panel down against upward movement. A fastener is not used to connect the clips to each other.

The preceding non-limiting aspects of the disclosure, as well as others, are more particularly described below. A more complete understanding of the devices, assemblies, and methods can be obtained by reference to the accompanying drawings, which are not intended to indicate relative size and dimensions of the assemblies. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
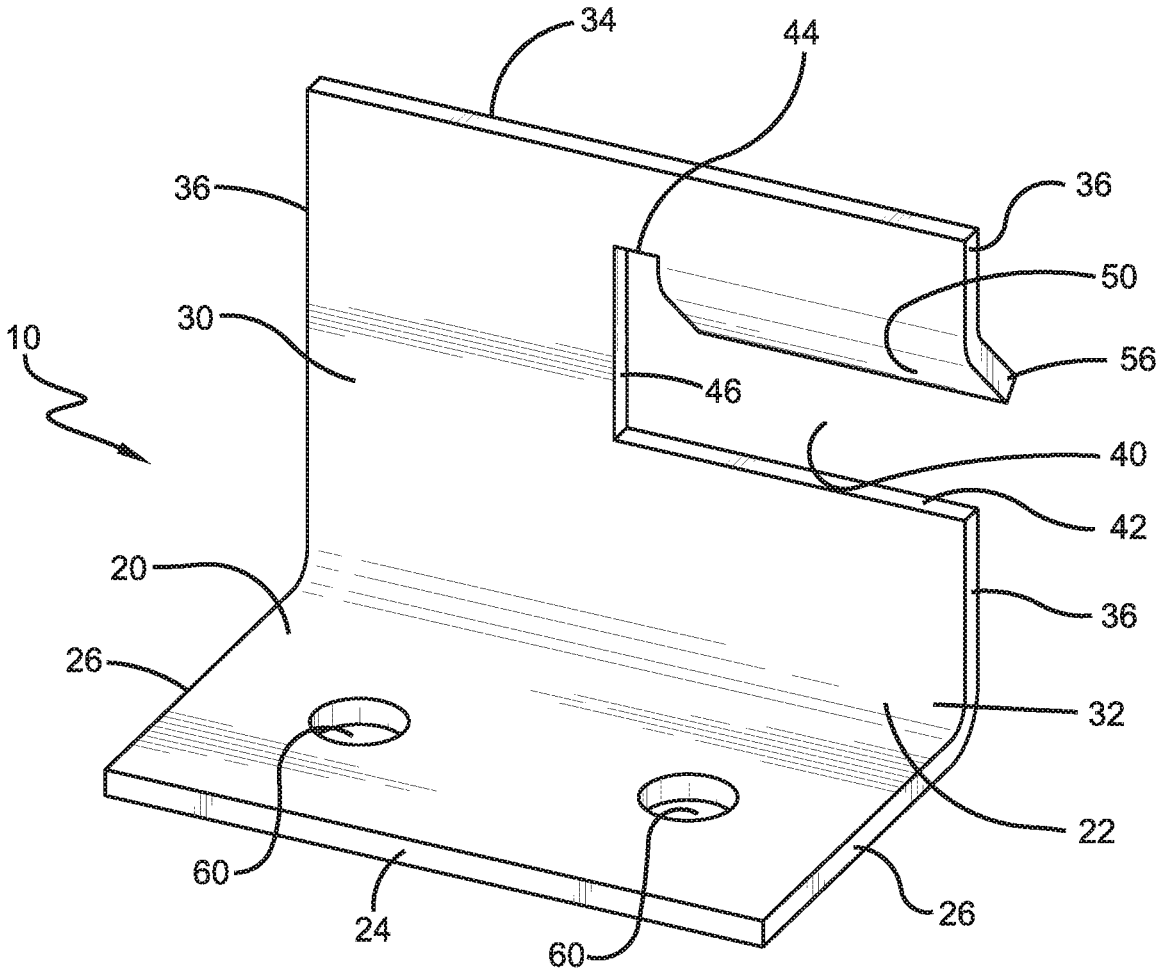
FIG. 1 is a rear perspective of an exemplary ceiling panel mounting clip.
Figure 2:
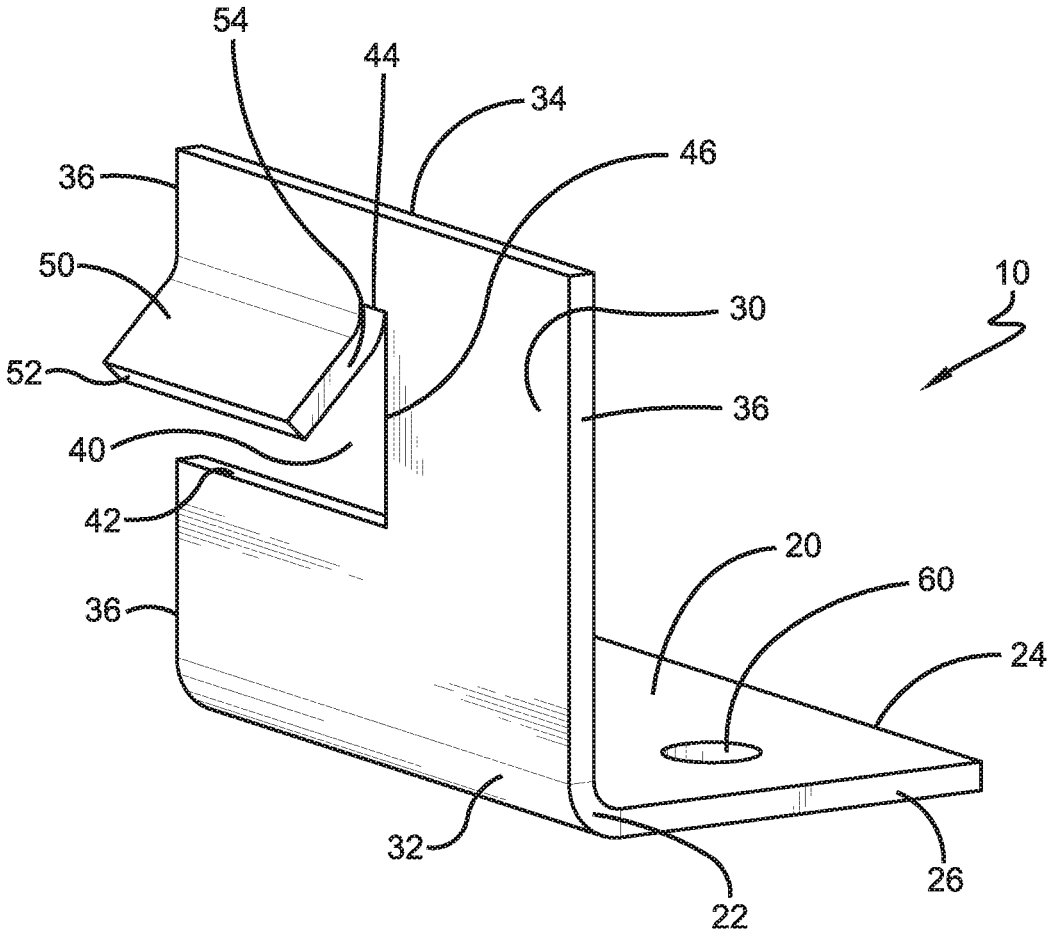
FIG. 2 is a front perspective thereof.
Figure 3:
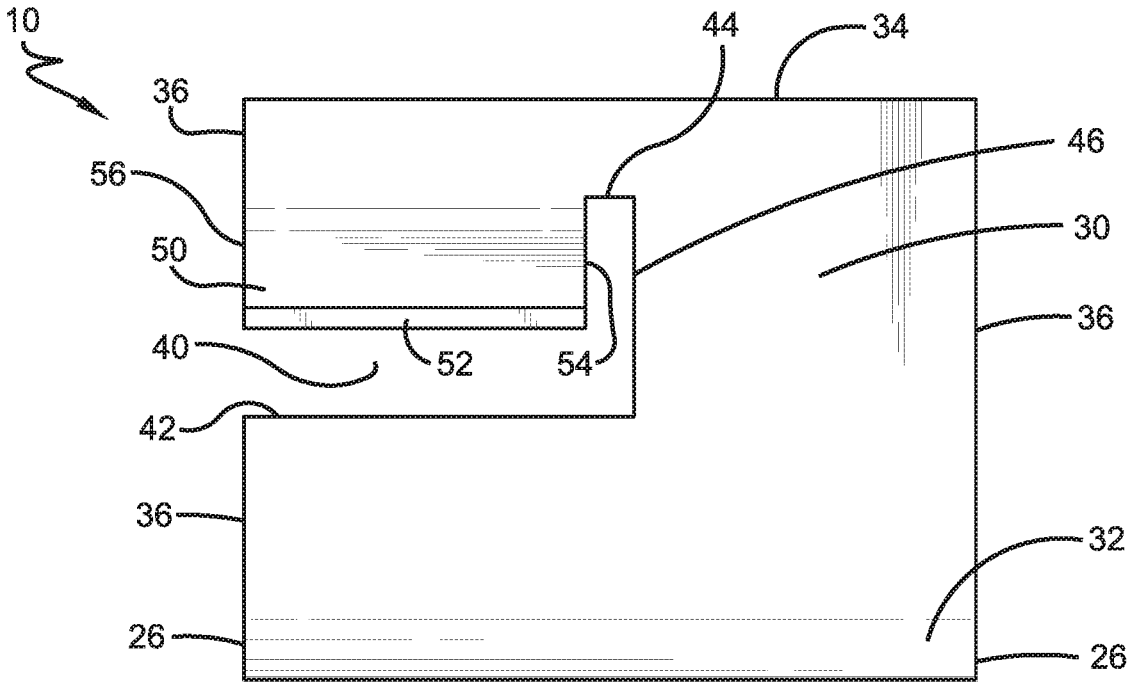
FIG. 3 is a front elevation view thereof.
Figure 4:
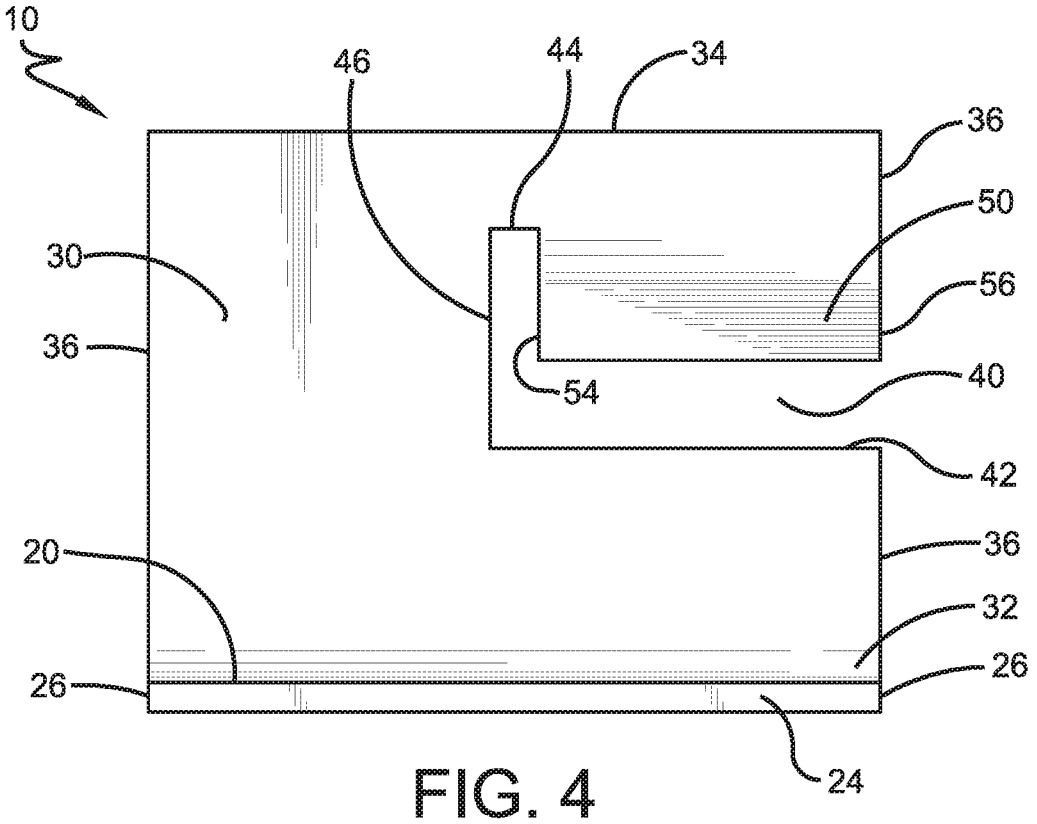
FIG. 4 is a rear elevation view thereof.
Figure 5:
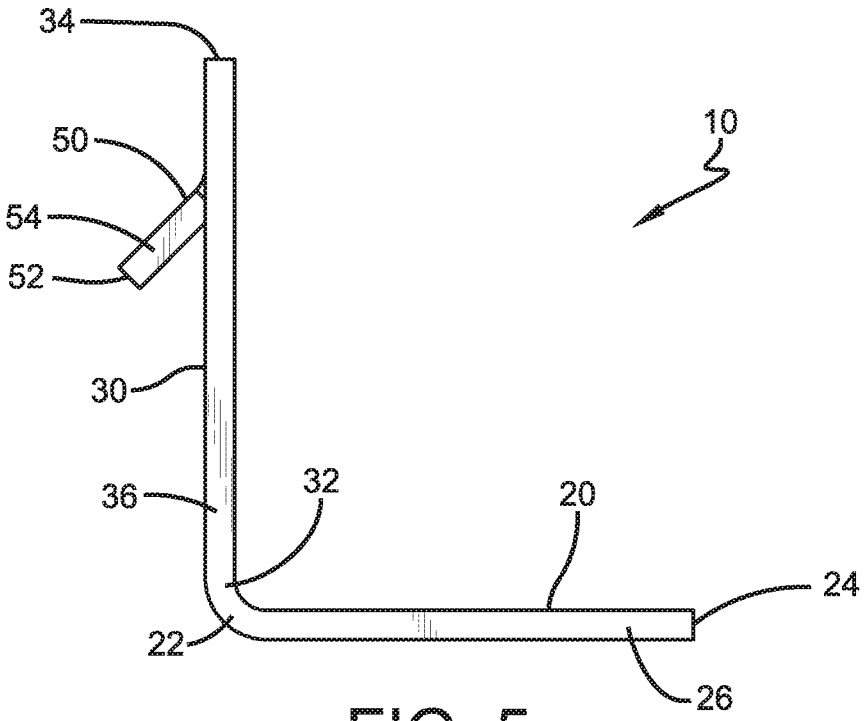
FIG. 5 is right side elevation thereof.
Figure 6:
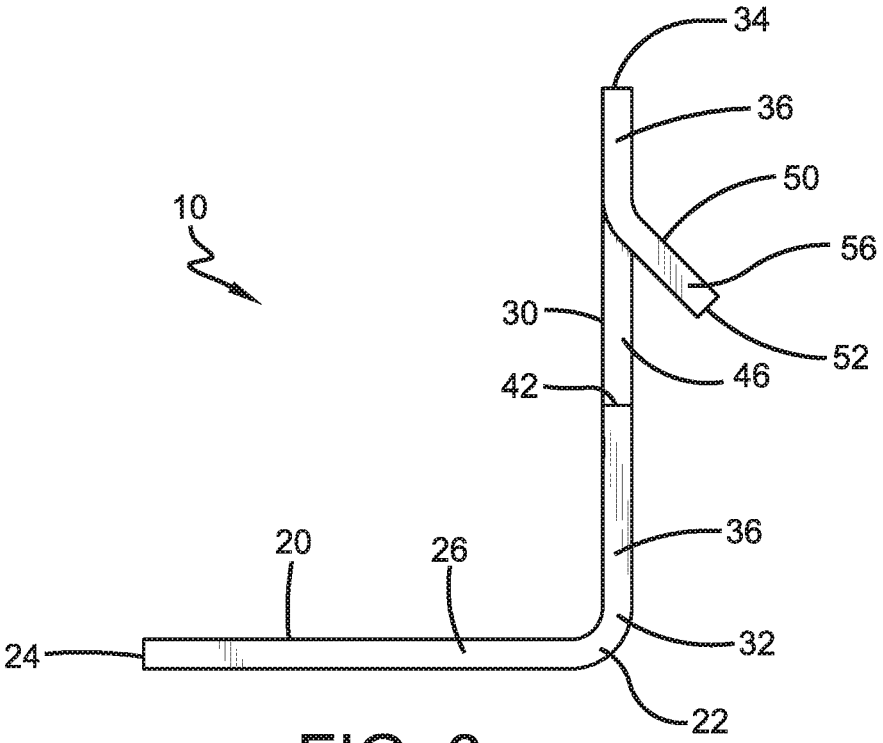
FIG. 6 is a left side elevation thereof.
Figure 7:
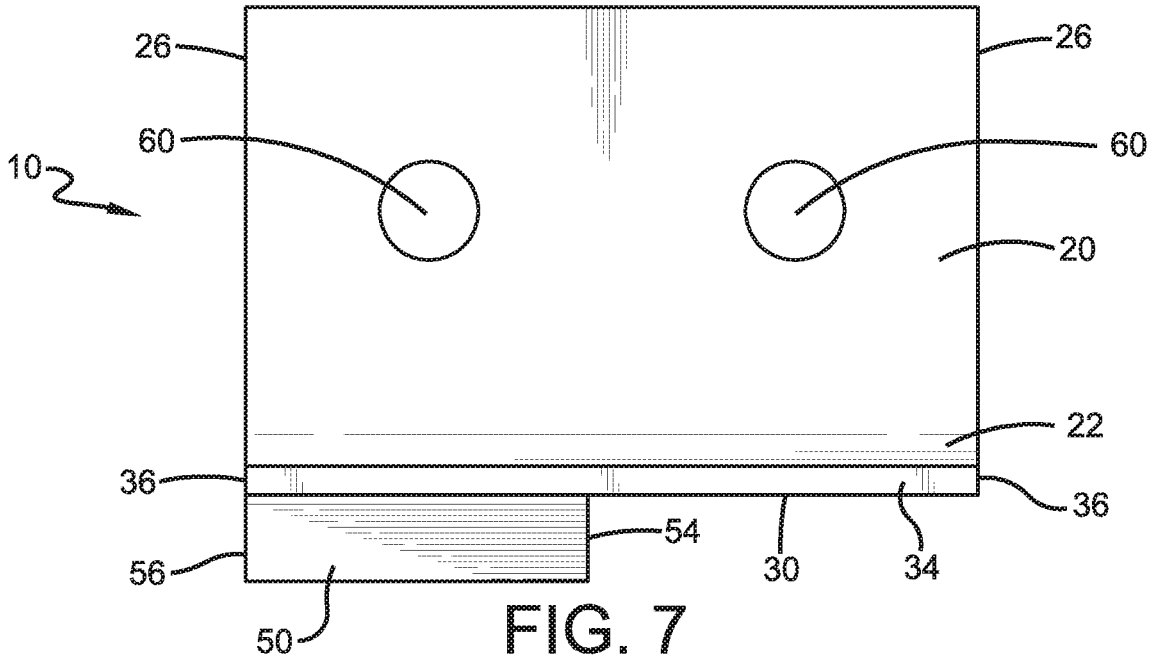
FIG. 7 is a top plan view thereof.
Figure 8:
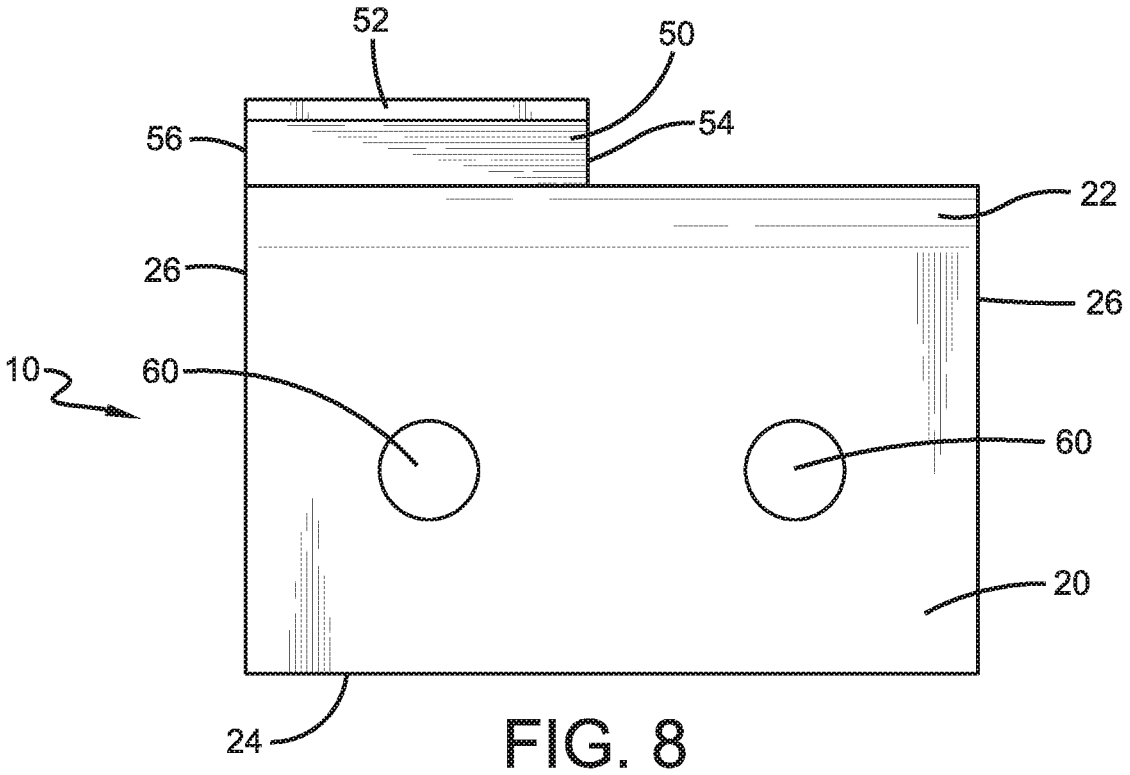
FIG. 8 is a bottom plan view thereof.

An exemplary configuration of a ceiling panel mounting clip is indicated generally by the reference numeral 10 in the accompanying drawings. Clip 10 is interlocked with a second clip (typically as copy of itself) to mount a ceiling panel 12 from a ceiling 14 with the interlocked clips 10 hidden from view from below the panel 12. The interlocked clips 10 hold the ceiling panel 12 while being free of one or more fasteners holding the clips 10 together themselves. When hanging ceiling panel 12, the weight of panel 12 holds the interlocked configuration of clips 10. The interlocked clips 10 restrain movement of the ceiling panel 12 in the lateral and downward directions. A single pair of clips can be used to mount a panel but typically a plurality of clip pairs are used to mount the panel from the ceiling.

In the exemplary configuration, ceiling panel mounting clip 10 includes a base 20 having a front end 22, a rear end 24, and lateral edges 26. An arm 30 projects away from base 20. Arm 30 has a lower end 32, an upper end 34, and lateral edges 36. Arm 30 defines an opening 40 through one of its lateral edges 36. Arm 30 has a lower edge 42, an upper edge 44, and a central edge 46 that define the boundaries of opening 40. A lock tab 50 projects from arm 30 away from opening 40. In the exemplary configuration, lock tab 50 projects down towards lower end 32 from an upper portion of arm 30 between upper edge 44 and lateral edge 36. Lock tab 50 is disposed at a forty-five degree angle with respect to arm 30. Lock tab 50 also projects in the forward direction such that lock tab 50 is not disposed directly over base 20. Lock tab 50 has a lower or outer end 52, an upper end connected to the upper portion of arm 30, an inner lateral edge 54, and an outer lateral edge 56. Inner lateral edge 54 of lock tab 50 is spaced from central edge 46 of arm 30 by a gap. Outer lateral edge 56 of lock tab 50 is substantially coplanar with lateral edge 36 of arm 30.

Figure 9:
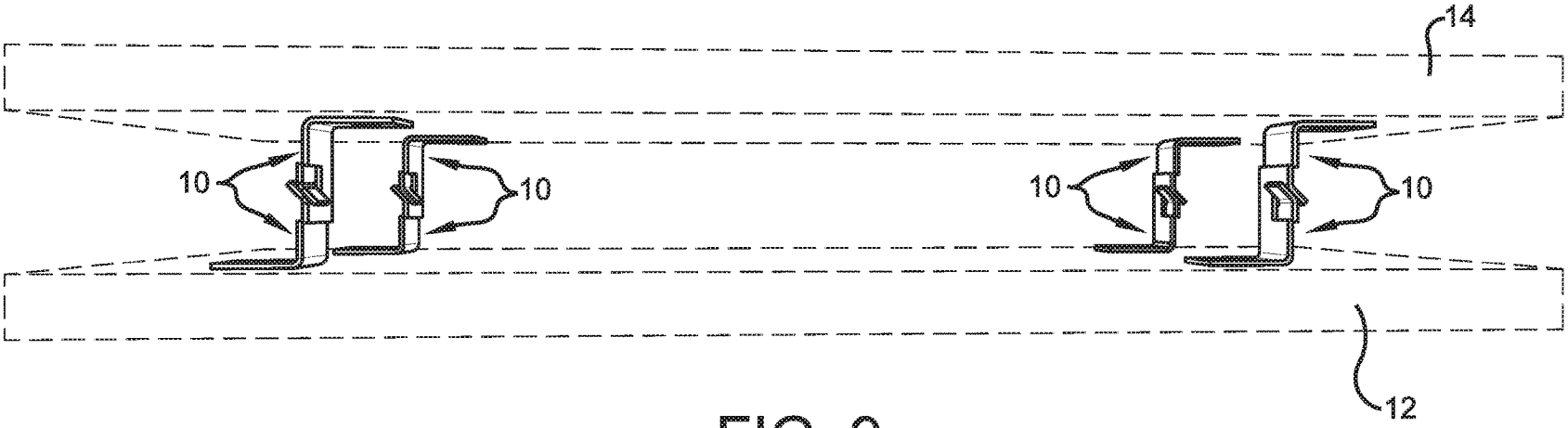
FIG. 9 is a perspective view of eight ceiling panel mounting clips joined together in four sets to mount a ceiling panel below a ceiling.
Figure 10:
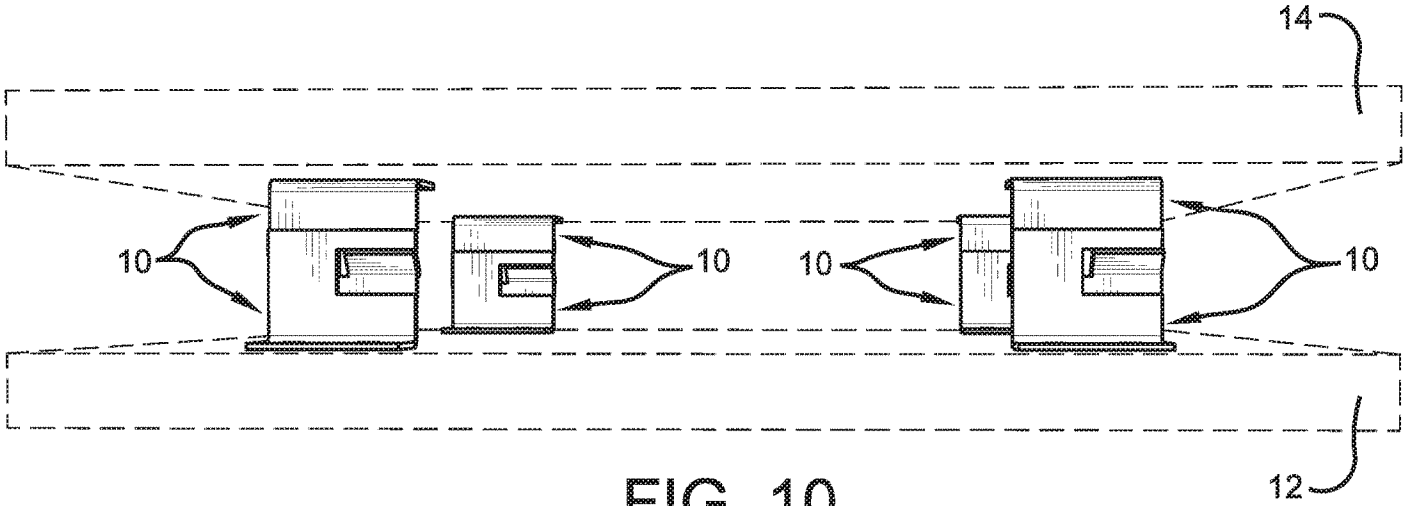
FIG. 10 another perspective view of the arrangement depicted in FIG. 9.

Clip 10 can be interlocked with a copy of itself or a similar clip as shown in FIGS. 9 and 10 with the lock tab 50 of one clip extending through the opening 40 of the other clip 10 with lock tabs 50 of the two clips 10 engaging each other. In the interlocked condition, the front surfaces of the arms 30 are disposed against one another to restrain lateral movement. Also, inner lateral edge 54 of each lock tab 50 engages central edge 46 of the other clip 10 to restrain lateral movement between clips 10. Although the drawings depict each pair of interlocked clips as using two identical clips 10, the geometry of the clips does not have to be identical for the clips to interlock to support ceiling panel 12. For example, the arm of one clip can be longer than the arm on the other clip, bases can have different shapes, or other aspects of the geometry can vary as described in examples below.

Figure 12:
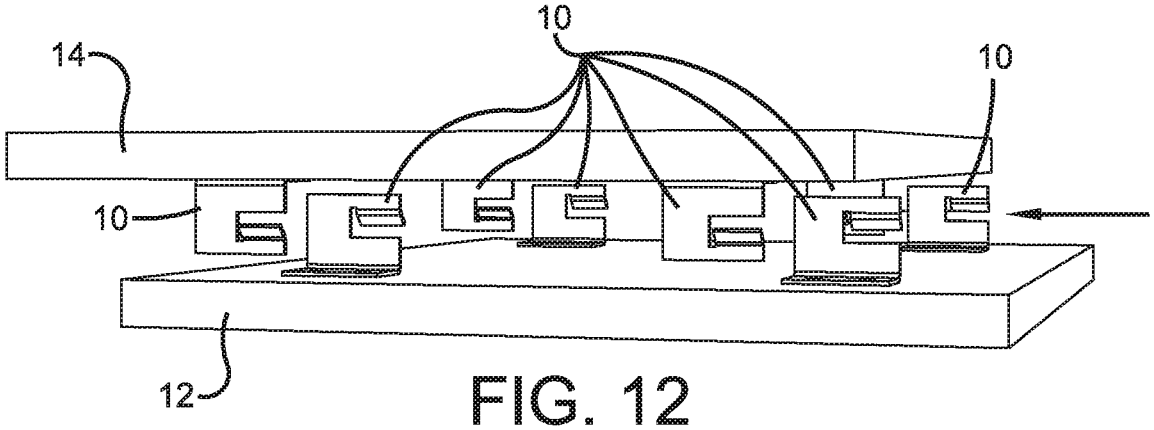
FIG. 12 shows a step of the mounting method wherein the lock tabs of the clips connected to the ceiling panel have been lifted to a position above the lock tabs of the clips connected to the ceiling.

In the exemplary configuration, clip 10 has a constant thickness and is made from 16 gauge galvanized or 304 stainless steel. Other thicknesses can be used as desired for particular applications. Other materials can be used such as other metals and polymers. In this configuration, clip 10 is formed from a single piece of material with a bend between base 20 and arm 30 and another bend between lock tab 50 and arm 30. Clip 10 can be molded. Clip 10 can be formed by connecting pieces together such as by welding arm 30 to base 20 and welding lock tab 50 to arm 30. In the exemplary configuration, clip 10 has a constant width (between lateral edges 26 and between lateral edges 36) of 1.500 inches. Lock tab 50 is 0.700 inches wide with the gap defined below upper edge 44 being 0.100 inches wide causing arm 30 to also have a width of 0.700 inches beside opening 40. In this configuration, the gap under upper edge 44 is centered with respect to arm 30. Base 20 is 1.000 inches long as measured from the front surface of arm 30 to rear end 24. Arm 30 is 1.130 inches tall as measured from the bottom surface of base 20 to the upper end 34 of arm 30. Lower edge 42 is spaced 0.540 inches from the bottom surface of base 20. This dimension provides enough space for one lock tab 50 to be raised over the other lock tab 50 as shown in FIG. 12 when the clips 10 are being interlocked and clips 10 are attached to the panel and the ceiling. The portion of lock tab 50 that extends in front of the front surface of arm 30 is 0.250 inches long and its upper or front surface forms a 135 degree angle with the front surface of the upper portion of arm 30. The lower or rear surface of lock tab 50 forms a 45 degree angle with arm 30. The upper portion of arm 30 from which lock tab 50 projects is about 0.250 inches tall (including some of the bend between lock tab 50 and arm 30). As such, if lock tab 50 were bent back to be in the same reference plane as arm 30, a gap of 0.100 inches would be disposed between lower edge 42 and the lower end of lock tab 50. When two of these clips 10 are interlocked, the total height of the interlocked combination is 1.375 inches as measured between the bottom surfaces of bases 20.

Base 20 defines optional fastener openings 60 (0.203 inch diameter spaced 0.500 inches from rear end 24) which allow base 20 to be secured to the upper surface of panel 12 or the lower surface of ceiling 14 with fasteners such as threaded screws, bolts, rivets, or other mechanical fasteners. Base 20 can be provided without openings 60 and fasteners can be used that bore their own holes. Alternatively, some configurations of ceiling panels are light and can be secured to base 20 with an adhesive or hook and loop or hook and hook fasteners.

In the exemplary configuration, base 20 is rectangular with parallel lateral edges 26. In other configurations, lateral edges 26 can converge, diverge, or can be curved. Curved lateral edge 26 can join at a point to define a semi-circular shape to base 20.

In the exemplary configuration, arm 30 is rectangular with parallel lateral edges 36. In other configurations, lateral edges 36 can converge, diverge, or can be curved. Arm 30 can be semi-circular. In the exemplary configuration, lock tab 50 is about half the width of arm 30 but it can be provided in configurations that are substantially more than half or substantially less than half of the arm width. Upper edge 44 is disposed just above the bent portion of arm where lock tab 50 joins the upper portion of arm 30. Opening 40 is generally rectangular to match the shape of lock tab 50. Lock tab 50 can have non-parallel lateral edges itself.

Arm 30 is depicted as being perpendicular to base 20. In other configurations, arm 30 can form other angles with base 20. For example, clips having arm 30 disposed at angles from 45 to 135 degrees can be used. Other angles for the angle of lock tab 50 with respect to arm 30 can be used. Lock tab 50 can project rearward from arm 30 so that it is directly above base 20.

Figure 11:
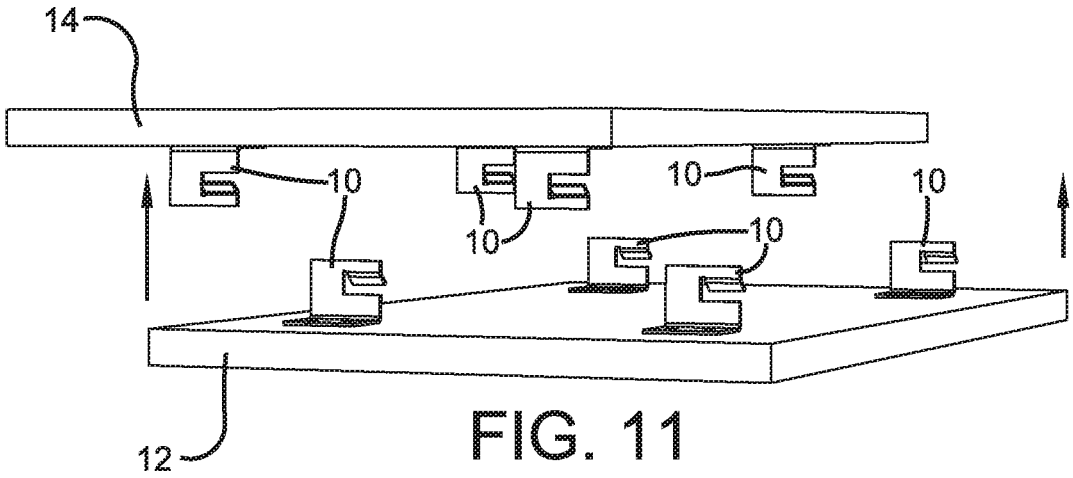
FIG. 11 is a perspective view of four ceiling panel mounting clips mounted to the top of a ceiling panel and four ceiling panel mounting panel clips mounted to the bottom of a ceiling where the ceiling panel is to be mounted.
Figure 13:
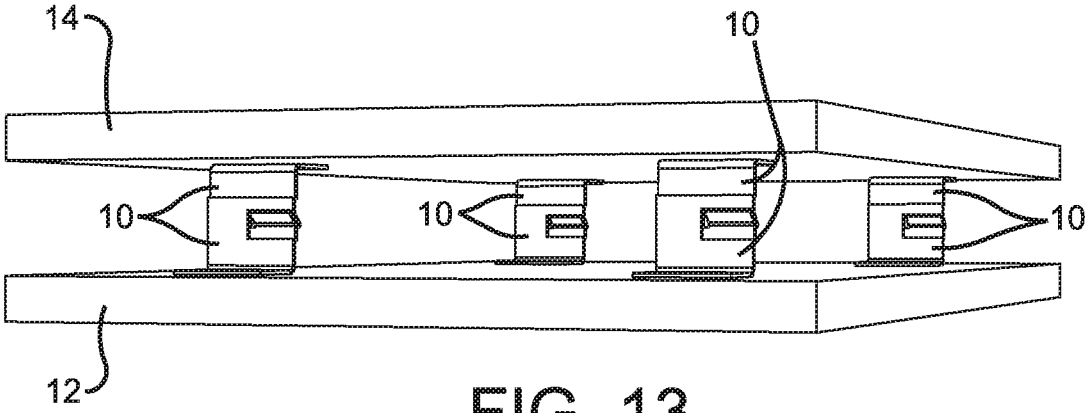
FIG. 13 shows the ceiling panel mounted to the ceiling with four sets of ceiling panel mounting clips.

FIGS. 9 and 10 depict a configuration with four clips 10 secured to ceiling panel 12 which can be a 2 foot by 4 foot panel 12. A plurality of these can be installed below ceiling 14 to provide a desirable appearance to the ceiling. A typical gap size between the edges of panels 12 is ¼" or ⅜". Weights of panel 12 vary greatly but an exemplary panel 12 can be 2 foot wide by 4 foot long by ¾ inch thick medium-density fiberboard (MDF) veneered panel. This panel can be about 3.2 pounds per square foot giving it a weight of about 25.6 pounds. Clips 10 are arranged inward from the corners of panel 12 and corresponding clips 10 are secured to ceiling 14 in locations that allow all eight clips 10 interlock at the same time. A template can be used to locate clips 10 on both panel 12 and ceiling 14. After all eight clips 10 are in place, panel 12 is lifted to generally align clips 10 as shown in FIG. 11. Panel 12 is then moved up so outer ends 52 of lock tabs 50 are higher than the portions of lock tabs 50 on clips 10 secure to ceiling 14. This allows the lock tabs 50 to interlock as shown in FIG. 13. In this condition, panel 12 is restrained against lateral and downward movements but can be removed if needed. No fasteners are need between clips 10.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A ceiling panel mounting clip, comprising:

a base having a front end, a rear end, and lateral edges;

an arm projecting away from the base; the arm having a lower end, an upper end, and lateral edges;

the arm defining an opening through one of its lateral edges; the arm having a lower edge, an upper edge, and a central edge that define the boundaries of the opening;

an upper portion of the arm being defined between the upper end of the arm and the opening;

a lock tab projecting from the upper portion of the arm away from the opening;

the lock tab having an outer end, an upper end connected to the upper portion of the arm, an inner lateral edge, and an outer lateral edge; and wherein the inner lateral edge of the lock tab is spaced from the central edge of the arm by a gap.

2. The mounting clip of claim 1, wherein the outer lateral edge of the lock tab is substantially coplanar with the lateral edge of the arm which defines a portion of the opening of the arm.

3. The mounting clip of claim 2, wherein the gap is centered with respect to the arm.

4. The mounting clip of claim 3, wherein the lock tab projects forwardly away from base.

5. The mounting clip of claim 1, wherein the base defines fastener openings.

6. The mounting clip of claim 1, wherein the arm is substantially perpendicular to the base.

7. The mounting clip of claim 6, wherein the lock tab forms a 45 degree angle with the arm.

8. The mounting clip of claim 1, wherein the arm projects from the front end of the base.

9. The mounting clip of claim 1, wherein the base, arm, and lock tab are integrally formed.

10. The mounting clip of claim 9, wherein the base, arm, and lock tab are formed from sixteen gauge galvanized steel.

11. The mounting clip of claim 1, wherein the lateral edges of the base are parallel and define the width of the base; the lateral edges of the arm are parallel and define the width of the arm; the width of the base being substantially the same as the width of the arm.

12. The mounting clip of claim 1, wherein the lock tab has an outer end, an upper end connected to the upper portion of the arm, an inner lateral edge, and an outer lateral edge.

13. An assembly of interlocked first and second ceiling panel mounting clips adapted to mount a ceiling panel below a ceiling; the assembly comprising:

first and second ceiling panel mounting clips; each of the first and second ceiling panel mounting clips including: a base having a front end, a rear end, and lateral edges; an arm projecting away from the base; the arm having a lower end, an upper end, and lateral edges; the arm defining an opening through one of its lateral edges; the arm having a lower edge, an upper edge, and a central edge that define the boundaries of the opening; an upper portion of the arm being defined between the upper end of the arm and the opening; and a lock tab projecting from the upper portion of the arm away from the opening;

the first and second ceiling panel mounting clips being interlocked with the lock tab of the first ceiling panel mounting clip being disposed through the opening of the second ceiling panel mounting clip and the lock tab of the second ceiling panel mounting clip being disposed through the opening of the first ceiling panel mounting clip;

the lock tab of the first ceiling panel mounting clip engaging the lock tab of the second ceiling panel mounting clip;

the central edge of the arm of the second ceiling panel mounting clip limiting lateral movement of the lock tab of the first ceiling panel mounting clip and the central edge of the arm of the first ceiling panel mounting clip limiting lateral movement of the lock tab of the second ceiling panel mounting clip; and the base of the first ceiling panel mounting clip adapted to be connected to the ceiling panel and the base of the second ceiling panel mounting clip adapted to be connected to the ceiling.

14. The assembly of claim 13, wherein the arm of the first ceiling panel mounting clip is substantially perpendicular to the base of the first ceiling panel mounting clip and wherein the arm of the second ceiling panel mounting clip is substantially perpendicular to the base of the second ceiling panel mounting clip.

15. The assembly of claim 13, wherein the lock tab of the first ceiling panel mounting clip forms a 45 degree angle with the arm of the first ceiling panel mounting clip and wherein the lock tab of the second ceiling panel mounting clip forms a 45 degree angle with the arm of the second ceiling panel mounting clip.

16. The assembly of claim 13, wherein the arm of the first ceiling panel mounting clip projects from the front end of the base of the first ceiling panel mounting clip and wherein the arm of the second ceiling panel mounting clip projects from the front end of the base of the second ceiling panel mounting clip.

17. The assembly of claim 13, wherein the base, arm, and lock tab of each ceiling panel mounting clip are integrally formed.

18. The assembly of claim 17, wherein the base, arm, and lock tab are formed from sixteen gauge galvanized steel.

19. The assembly of claim 13, wherein the lateral edges of the base of the first ceiling panel mounting clip are parallel and define the width of the base of the first ceiling panel mounting clip; the lateral edges of the arm of the first ceiling panel mounting clip are parallel and define the width of the arm of the first ceiling panel mounting clip; the width of the base of the first ceiling panel mounting clip being substantially the same as the width of the arm of the first ceiling panel mounting clip and wherein the lateral edges of the base of the second ceiling panel mounting clip are parallel and define the width of the base of the second ceiling panel mounting clip; the lateral edges of the arm of the second ceiling panel mounting clip are parallel and define the width of the arm of the second ceiling panel mounting clip; the width of the base of the second ceiling panel mounting clip being substantially the same as the width of the arm of the second ceiling panel mounting clip.

20. The assembly of claim 13, wherein each base defines fastener openings.

21. An assembly of interlocked first and second ceiling panel mounting clips adapted to mount a ceiling panel below a ceiling; the assembly comprising:

first and second ceiling panel mounting clips;

each of the first and second ceiling panel mounting clips including: a base having a front end, a rear end, and lateral edges; an arm projecting away from the base; the arm having a lower end, an upper end, and lateral edges; the arm defining an opening; the arm having a lower edge, an upper edge, and a central edge that define the boundaries of the opening; an upper portion of the arm being defined between the upper end of the arm and the opening; and a lock tab projecting from the upper portion of the arm away from the opening;

the first and second ceiling panel mounting clips being interlocked with the lock tab of the first ceiling panel mounting clip being disposed through the opening of the second ceiling panel mounting clip and the lock tab of the second ceiling panel mounting clip being disposed through the opening of the first ceiling panel mounting clip;

the lock tab of the first ceiling panel mounting clip engaging the lock tab of the second ceiling panel mounting clip;

the central edge of the arm of the second ceiling panel mounting clip disposed beside the lock tab of the first ceiling panel mounting clip and the central edge of the arm of the first ceiling panel mounting clip disposed beside the lock tab of the second ceiling panel mounting clip; and the base of the first ceiling panel mounting clip adapted to be connected to the ceiling panel and the base of the second ceiling panel mounting clip adapted to be connected to the ceiling.

22. The assembly of claim 21, wherein the arm of the first ceiling panel mounting clip is substantially perpendicular to the base of the first ceiling panel mounting clip and wherein the arm of the second ceiling panel mounting clip is substantially perpendicular to the base of the second ceiling panel mounting clip.

23. The assembly of claim 21, wherein the lock tab of the first ceiling panel mounting clip forms a 45 degree angle with the arm of the first ceiling panel mounting clip and wherein the lock tab of the second ceiling panel mounting clip forms a 45 degree angle with the arm of the second ceiling panel mounting clip.

24. The assembly of claim 21, wherein the arm of the first ceiling panel mounting clip projects from the front end of the base of the first ceiling panel mounting clip and wherein the arm of the second ceiling panel mounting clip projects from the front end of the base of the second ceiling panel mounting clip.

25. The assembly of claim 21, wherein the lateral edges of the base of the first ceiling panel mounting clip are parallel and define the width of the base of the first ceiling panel mounting clip; the lateral edges of the arm of the first ceiling panel mounting clip are parallel and define the width of the arm of the first ceiling panel mounting clip; the width of the base of the first ceiling panel mounting clip being substantially the same as the width of the arm of the first ceiling panel mounting clip and wherein the lateral edges of the base of the second ceiling panel mounting clip are parallel and define the width of the base of the second ceiling panel mounting clip; the lateral edges of the arm of the second ceiling panel mounting clip are parallel and define the width of the arm of the second ceiling panel mounting clip; the width of the base of the second ceiling panel mounting clip being substantially the same as the width of the arm of the second ceiling panel mounting clip.

26. The assembly of claim 21, wherein each base defines fastener openings.

* * * * *